US008376416B2

(12) United States Patent
Arabia, Jr. et al.

(10) Patent No.: US 8,376,416 B2
(45) Date of Patent: Feb. 19, 2013

(54) LATCH SYSTEM FOR A DOOR OF AN AUTOMOBILE

(75) Inventors: Frank J. Arabia, Jr., Macomb, MI (US); Jeffrey L. Konchan, Romeo, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 729 days.

(21) Appl. No.: 12/204,086

(22) Filed: Sep. 4, 2008

(65) Prior Publication Data

US 2010/0052337 A1 Mar. 4, 2010

(51) Int. Cl.
*E05C 3/06* (2006.01)

(52) U.S. Cl. ..... 292/216; 292/201; 292/DIG. 23

(58) Field of Classification Search ..... 292/216, 292/201, DIG. 23; 340/426.28, 540
See application file for complete search history.

(56) References Cited

U.S. PATENT DOCUMENTS

| | | | | |
|---|---|---|---|---|
| 4,756,563 | A | 7/1988 | Garwood et al. | |
| 5,054,827 | A | 10/1991 | Konchan et al. | |
| 6,045,168 | A | 4/2000 | Johnson et al. | |
| 6,848,286 | B2 * | 2/2005 | Dimig | 70/277 |
| 7,199,710 | B2 * | 4/2007 | Hiramitsu et al. | 340/539.26 |
| 7,969,043 | B2 * | 6/2011 | Caraghiorghiopol et al. | 307/82 |
| 2005/0134120 | A1 * | 6/2005 | Nguyen et al. | 307/43 |
| 2007/0090655 | A1 * | 4/2007 | Smith | 292/201 |
| 2008/0224482 | A1 * | 9/2008 | Cumbo et al. | 292/216 |

* cited by examiner

*Primary Examiner* — Kristina Fulton
(74) *Attorney, Agent, or Firm* — Ingrassia Fisher & Lorenz, P.C.

(57) ABSTRACT

A system is provided for latching a door of an automobile. The system includes, but is not limited to, a first power source, second power source, a latch for the door coupled to the first power source and the second power source, and an electronic control unit configured to control an operation of the latch. The electronic control unit is further configured to determine a status of the first power source, evaluate the status of the first power source, and control the operation of the latch with the second power source if the evaluation of the status indicates the first power source is unavailable.

18 Claims, 3 Drawing Sheets

LATCH SYSTEM FOR A DOOR OF AN AUTOMOBILE

TECHNICAL FIELD

The present invention generally relates to latch system, and more particularly relates to a latch system for a door of an automobile.

BACKGROUND

Automobile development and design efforts have continued to reduce automobile mass and complexity. These development and design efforts have been focused on many automobile systems and components, and resulted in significant benefits. These benefits include, but are not limited to, improved automobile styling and architecture, reduced packaging and assembly, and the corresponding cost savings associated with reduced hardware and manufacturing and assembly simplification.

One system that has seen some of these benefits is the latching system for an automobile door. Current latching systems have been redesigned to replace interior and exterior latch handle assemblies, which were formed of numerous mechanical parts, with electronic switches. Current latching systems have also been redesigned to replace other interior and exterior mechanisms with electrical switches, including interior lock assemblies. However, existing latching systems still generally include mechanical latches driven by multiple motors, mechanical handles, release cables, handle rods, key cylinders, inside lock rods, and sill buttons for each door as a backup to open the door in the event that battery power is insufficient to electronically operate the door latch. As can be appreciated, further reduction of the mechanical releases and further reductions or simplification of these listed latch systems components, or other components not presented in this non-exhaustive list, would provide any one of the previously enumerated benefits and other unlisted or unexpected benefits.

Accordingly, it is desirable to provide a latching system for a door of an automobile having one or more previously or subsequently expressed benefits, implied benefits, or a benefit not implied or expressed herein. Furthermore, other desirable features and characteristics will become apparent from the subsequent summary and detailed description, and the appended claims, taken in conjunction with the accompanying drawings and this background.

SUMMARY

In accordance with an embodiment, a latch system is provided for a door of an automobile. The latch system includes, but is not limited to a first power source, a second power source, a latch for the door coupled to the first power source and the second power source. The latch system also includes, but is not limited to an electronic control unit configured to control an operation of the latch. The electronic control unit is further configured to determine a status of the first power source, evaluate the status of the first power source, and select the second power source for operation of the latch if the evaluation of the status indicates the first power source is insufficient to operate the latch.

In accordance with another embodiment, a latch system is provided for a first door and a second door of an automobile. The latch system for the first door and the second door includes, but is not limited to a first power source having a status and a second power source. The latch system further includes, but is not limited to a first latch assembly for the first door that is coupled to the first power source and the second power source, a second latch assembly for the second door that is coupled to the first power source and the second power source, and an electronic control unit coupled to the first power source, second power source, first latch assembly, and second latch assembly. The electronic control unit is at least configured to determine a status of the first power source, evaluate the status of the first power source, and select the second power source for operation of the first latch assembly and the second latch assembly if the evaluation of the status indicates the first power source is insufficient to operate the latch assembly.

In accordance with yet another embodiment, a latch system for a door of an automobile is provided that has, among other things, a first battery, a second battery, and a latch assembly for the door that is coupled to the first battery and the second battery. The latch assembly includes, but is not limited to a single motor, a cam and gear set coupled to the single motor, a detent lever coupled to the cam and gear set, a fork bolt lever configured to engage the detent lever, and a striker configured to engage the fork bolt lever. The latch system further includes, but is not limited to an electronic control unit configured to control an operation of the latch assembly. The electronic control unit is further configured to determine a status of the first power source, evaluate the status of the first power source, and control the operation of the latch assembly with the second power source if the evaluation of the status indicates the first power source is unavailable.

BRIEF DESCRIPTION OF THE DRAWINGS

At least one embodiment will hereinafter be described in conjunction with the following drawing figures, wherein like numerals denote like elements.

DETAILED DESCRIPTION

The following detailed description is merely exemplary in nature and is not intended to limit application and uses. In addition, there is no intention to be bound by any theory presented in the preceding background and summary or the following detailed description. Furthermore, it being understood that various changes may be made in the function and arrangement of elements described in an exemplary embodiment without departing from the scope as set forth in the appended claims and their legal equivalents.

Figure 1:
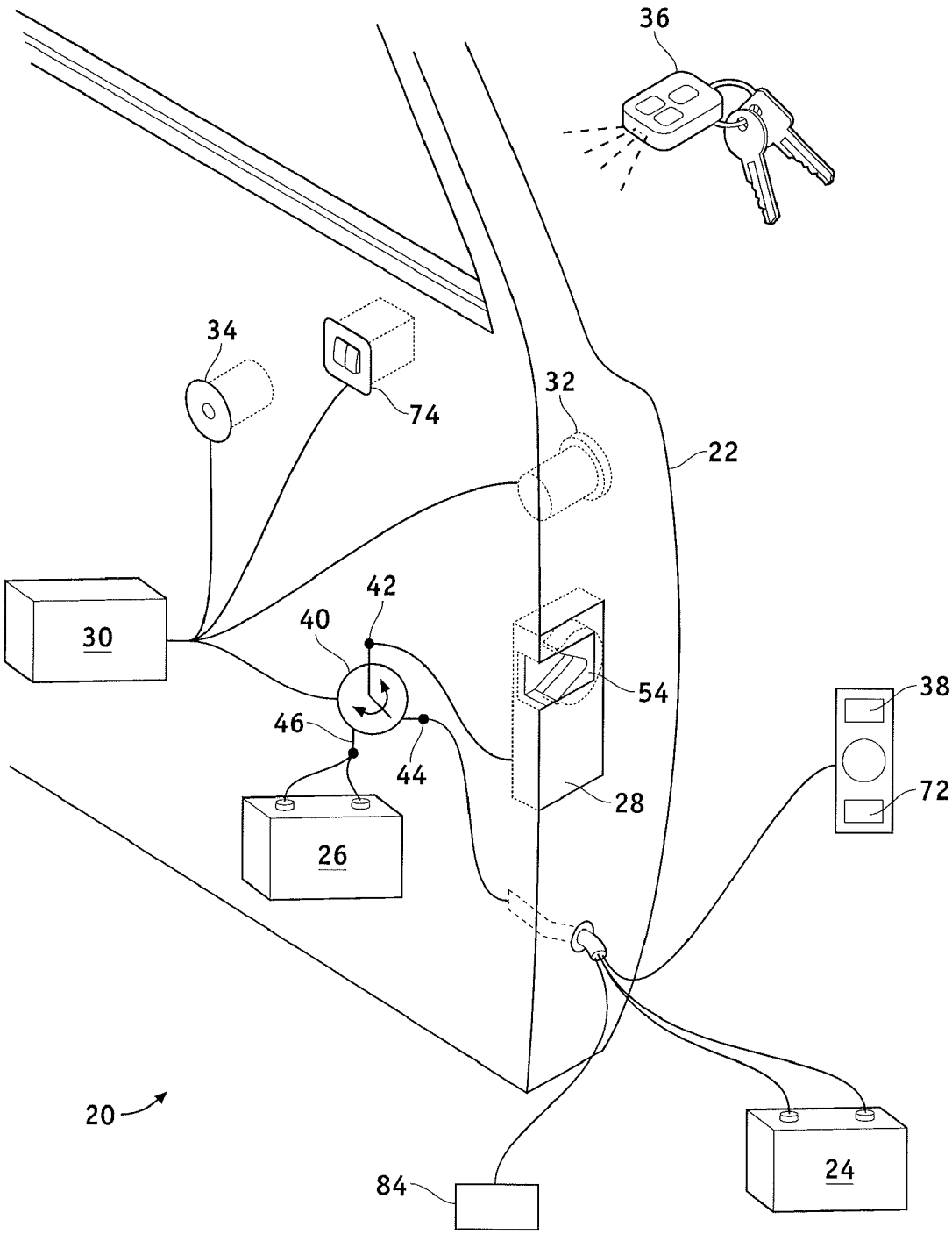
FIG. 1 is a latch system for a door of a automobile in accordance with an embodiment.

FIG. 1 shows the latch system 20 for a door 22 of an automobile (not shown) in accordance with an embodiment. Generally, the latch system 20 has, without limitation, a first power source 24, a second power source 26; and a latch assembly 28 for the door 22 coupled to the first power source 24 and the second power source 26. The latch system 20 also has, among other components and parts, an Electronic Control Unit (ECU) 30, such as a Body Control Unit (BCU), that is configured to control the latch assembly 28 and/or other body assemblies or function, or a Door Control Unit (DCU) dedicated to control operation of the latch assembly 28 and/or other vehicle access functions. The ECU 30 preferably has numerous capabilities, that include the capability of determining a status of the first power source 24, evaluating the status of the first power source 24, and selecting the second power source 26 for operation of the latch assembly 28 if the evaluation of the status indicates the first power source 24 is insufficient to operate the latch assembly 28. The selection of the second power source 26 by the ECU 30 for operation of the latch assembly 28 can be based upon any number determinations, evaluations, and/or event identifications in addition to the status determination and evaluation of the first power source 24.

In this example, the ECU 30 is preferably configured to identify and evaluate a request to change the state of the latch assembly 28, such as a request to change the state of the latch assembly 28 from a closed door configuration to an open door configuration. While the request to change the state of the latch assembly 28 can come from any number of sources, at least one source in this non-limiting embodiment is either a electronic handle switch 32 mounted for access from an exterior surface of the door 22 or an electronic handle switch 34 mounted for access from an interior surface of the door 22. The source can also be a wireless switch 36, such as a key fob switch, configured to wirelessly transmit the request signal or a non-door mounted switch 38 mounted to an interior or exterior surface other than the interior or exterior surface of the door 22, such as the surface of the center stack (not shown) typically located next the driver's seat (not shown).

At least one of these switches 32,34,36,38, and preferably more than one of these switches 32,34,36,38, generates an electrical, optical or acoustical signal upon activation. The activation can be an application of an operating force to a switch actuator or detection of an object (e.g., a hand and/or finger) in proximity to the switch, depending upon the switch type. The switches 32,34,36,38, which are Single-Pole, Single-Throw (SPST) switches in this example, generate the signals that are received by the ECU 30. Upon receiving such a signal, the ECU 30 determines the status of the first power source 24 as a power source for operation of the latch assembly 28.

In this example, the first power source 24 is the primary power source of the automobile, such as a Direct Current (DC) battery, and the status is a voltage level of the DC battery. However, other sources may be designated as the first power source 24, including an Alternating Current (AC) power source with an AC-to-DC converter (ADC), and the status can be other characteristics or parameters in addition to the voltage level or as a substitute for the voltage level. The ECU 30 determines the voltage level and evaluates whether the voltage is sufficient to change the state of the latch assembly 28. If the power is sufficient to change the state (e.g., change the configuration of the latch assembly from a closed state to an open state), the ECU 30 couples the first power source 24 (e.g., the battery) to the latch assembly 28.

This coupling of the first power source 24 to the latch assembly 28 can be performed with any number of devices or combination of devices. For example, a Single Pole, Double Throw (SPDT) switch 40 having a common terminal 42 coupled to the latch assembly 28 and a first line terminal 44 coupled to the first power source 24 and a second line terminal 46 coupled to the second power source 26. The switch 40 is controlled by the ECU 30 such that one throw position couples the first power source 24 to the latch assembly 28 if the determination is made that the power available from the first power source 24 is sufficient to change the state of the latch assembly 28, and a second throw position couples the second power source 26 to the latch assembly 28 if the determination is made that the power available from the first power source 24 is insufficient to make such a state change.

Functionally, the second power source 26 is a backup power source for operation of the latch assembly 28. However, the second power source 26 can also be used for other functions and processes of the door 22, other doors, or automobile functions. The second power source 26 can be any number of AC or DC power sources, such as an additional DC battery and/or a capacitor. Once the ECU 30 has determined the first power source 24 is insufficient, the latch assembly 28 is supplied with power from the second power source 26 for operation.

Figure 2:
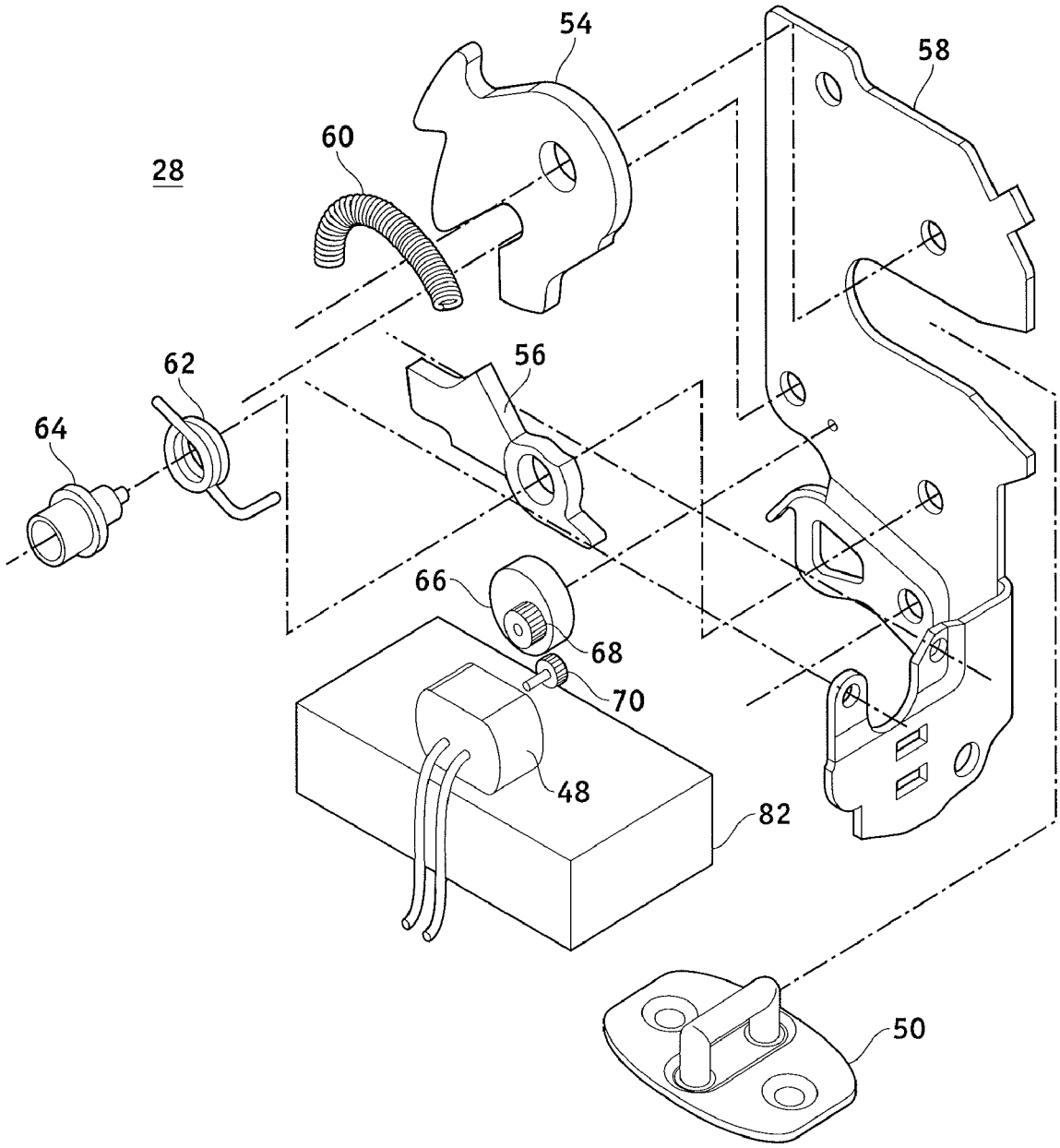
FIG. 2 is the latch of FIG. 1 in accordance with an embodiment.

One example of the latch assembly 28 is shown in FIG. 2, but the exact configuration of the latch assembly 28 is not critical; and so other configurations are possible. Moreover, any number of latch assembly configurations can be utilized that have a mechanical latch, traditional detent, and spring latching of a fork bolt lever or other future or existing mechanical or electromechanical arrangements that release with at least one motor actuating detent. However, the release could be accomplished with or without a cinch, detent or other features as long as the door is released upon activation and held in a substantially closed position prior to the release.

For purposes of this embodiment, the latch assembly 28 need only have a motor 48. In this example, the motor is also configured to drive the mechanical operation to provide an open state of the latch assembly 28 that disengages a fork bolt lever 54 from the striker 50. These parts and other parts are discussed in detail in the U.S. Pat. Nos. 4,756,563, 5,054,827, and 6,045,168, which are herein incorporated in their entirety by reference.

In addition to the motor 48, striker 50, and fork bolt lever 54, the latch assembly 28 includes, a detent lever 56 located in a chamber of a plastic housing behind a metal face plate 58. An elongated coil spring 60 is disposed in a curved slot in the plastic housing behind the fork bolt lever 54, and engages a depending pin of the fork bolt lever 54 at one end. The detent lever 56 is biased into engagement with the fork bolt lever 54 by a coil spring 62 that surrounds a bushing 64 that has one end engaging a housing (not shown) and one end engaging an ear of the detent lever 56. A cam 66 and gears 68,70 couple the motor 48 to the detent lever 56.

The detent lever 56 engages the fork bolt lever 54 in either an intermediate or full latched position against the bias of coil spring 60 and the seal force of the door 22. The detent lever 56 continue to hold the fork bolt lever 54 in the intermediate or full latched positions until the motor 48 moves detent lever 56. When the motor 48 moves the detent lever 56 against the force of the coil spring 60 and the seal force of the door 22; and this releases the fork bolt lever 54. The coil spring 60 forces the fork bolt lever 54 back into the unlatched position, allowing the striker 50 to pull out of the fork bolt lever 54.

This example operation of the latch assembly 28 is preferably conducted with a single motor. However, additional motors can be used to operate the previously described latch assembly. The motor 48, which is preferably housed in a water resistant enclosure 82 rotates upon receiving a signal from the ECU, which selects the appropriate power source and transmits a signal to the motor 48 after receiving a signal from one of the switches.

Referring to FIG. 1, the ECU 30 can be also be configured to control the operation of the motor 48 and select the appropriate power source based upon other vehicle information. For example, the ECU 30 can be adapted to receive data from one or more theft sensors 84, and inhibit use of the second power source 26 to open the door upon identification of a vehicle tampering or break-in. In this way, a criminal or unauthorized user would be unable to disconnect the first power source 24 in order to gain access to the vehicle using the second power source 26. The ECU 30 can also be adapted to receive data from a child safety switch 72 or a door lock 74 and inhibit an opening of the door 22 with one of the switches 32,34,36,38 when the child safety switch is selected to maintain a closed door. These two examples are but a limited number of possibilities that are available for selection of a primary or backup power source and control the opening or closing of the door 22. Moreover, other possibilities exist for the location of the ECU 30, first power source 24, second power source 26, switches 32,34,36,38, and other arrangements are available for control of other doors in addition to the door 22 shown in FIG. 1.

Figure 3:
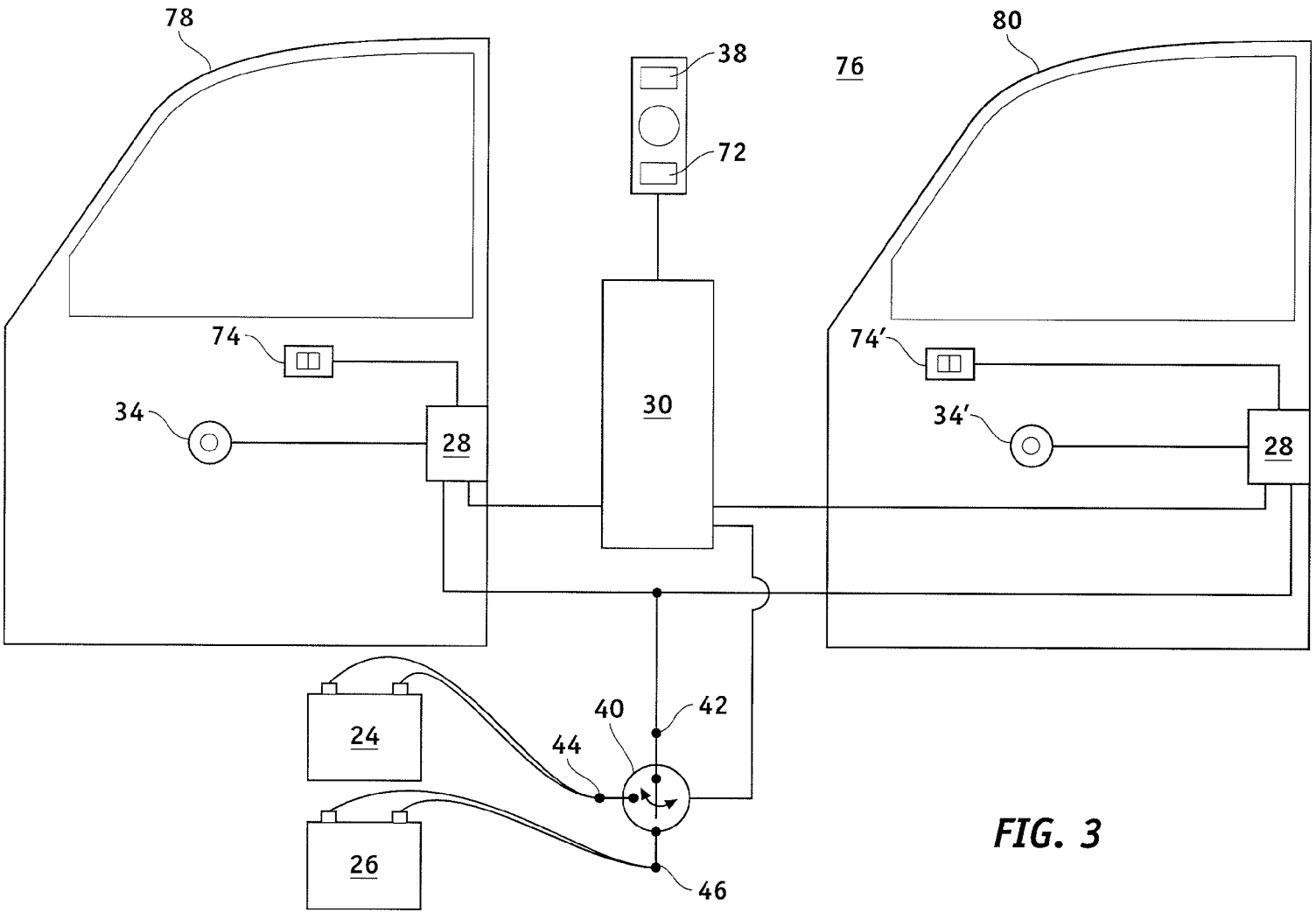
FIG. 3 is a latch system for multiple doors of an automobile in accordance with another embodiment.

For example, and with reference to FIG. 3, latching system 76 is illustrated in accordance with another embodiment. The ECU 30, first power source 24, and second power source 26 can be used for multiple doors 78,80. While only two doors are shown, more than two doors can be operated and controlled by the ECU 30 and/or powered by the first power source 24 and second power source 26. The ECU 30, first power source 24 and/or second power source 26 can be located externally to each of the doors 78,80 or located within one of the doors while controlling and/or powering the other door. The arrangement and distribution of these elements provide many embodiments in addition to the embodiments presented in the foregoing summary and detailed description. Therefore, it should be appreciated that a vast number of variations exist.

It should also be appreciated that the exemplary embodiment or exemplary embodiments are only examples, and are not intended to limit scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents.

What is claimed is:

1. A latch system for a door of an automobile, comprising:
- a first power source;
- a second power source;
- a latch assembly for the door coupled to the first power source and the second power source;
- an electronic control unit configured to control an operation of the latch assembly, the electronic control unit further configured to:
- determine a status of the first power source,
- evaluate the status of the first power source, and
- select the second power source for operation of the latch assembly if the evaluation of the status indicates the first power source is insufficient to operate the latch assembly; and
- a Single-Pole, Double-Throw (SPDT) switch having a common terminal coupled to the latch assembly, a first line terminal coupled to the first power source, and a second line terminal coupled to the second power source,
- wherein the electronic control unit is configured to place the SPDT switch in a first throw position that couples the first power source to the latch assembly when the evaluation of the status indicates that the first power source is sufficient to operate the latch assembly and in a second throw position when the evaluation of the status indicates that the first power source is insufficient to operate the latch assembly.

2. The latch system of claim 1, further comprising an electronic handle switch coupled to the electronic control unit, the electronic control unit further configured to control the operation of the latch assembly based at least in part upon an activation of the electronic handle switch.

3. The latch system of claim 2, wherein the electronic handle switch is mounted to an interior of the door.

4. The latch system of claim 1, further comprising a wireless switch wirelessly coupled to the electronic control unit.

5. The latch system of claim 1, wherein the first power source is a battery.

6. The latch system of claim 1, wherein the second power source is a battery.

7. The latch system of claim 1, wherein the second power source is a capacitor.

8. The latch system of claim 1, wherein the electronic control unit is a body control unit.

9. The latch system of claim 1, further comprising a theft sensor coupled to the electronic control unit, the electronic control unit further configured to evaluate the theft sensor and inhibit operation of the latch assembly upon detection of a break-in.

10. The latch system of claim 1, further comprising a latch assembly having a single motor.

11. The latch system of claim 10, further comprising a water resistant structure enclosing the single motor.

12. A latch system for a first door and a second door of an automobile, comprising:
- a first power source having a status;
- a second power source;
- a first latch assembly for the first door that is coupled to the first power source and the second power source;
- a second latch assembly for the second door that is coupled to the first power source and the second power source; and
- an electronic control unit coupled to the first power source, the second power source, the first latch assembly, and the second latch assembly, the electronic control unit configured to:
- determine a status of the first power source,
- evaluate the status of the first power source, and
- select the second power source for operation of the first latch assembly and the second latch assembly if the evaluation of the status indicates the first power source is insufficient to operate the latch assembly a Single-Pole, Double-Throw (SPDT) switch having a common terminal coupled to the first and second latch assemblies, a first line terminal coupled to the first power source, and a second line terminal coupled to the second power source, wherein the electronic control unit is configured to place the SPDT switch in a first throw position that couples the first power source to the first and second latch assemblies when the evaluation of the status indicates that the first power source is sufficient to operate the first and second latch assemblies and in a second throw position when the evaluation of the status indicates that the first power source is insufficient to operate the first and second latch assemblies.

13. The latch system of claim 12, wherein the first latch assembly comprises a single motor.

14. The latch system of claim 12, wherein the electronic control unit is externally located from the first door and the second door.

15. The latch system of claim 12, wherein the second power source is located within the first door.

16. The latch system of claim 12, wherein the first power source is a battery.

17. The latch system of claim 12, wherein the second power source is a capacitor.

18. The latch system of claim 12, further comprising a first handle switch and a second handle switch coupled to the electronic control unit, the electronic control unit further configured to control a first operation of the first latch assembly based at least in part upon a first activation of the first handle switch and control a second operation of the second latch assembly based at least in part upon a second activation of the second handle switch.

* * * * *